US008334827B2

(12) United States Patent
Seo et al.

(10) Patent No.: US 8,334,827 B2
(45) Date of Patent: Dec. 18, 2012

(54) ORGANIC LIGHT EMITTING DIODE DISPLAY DRIVEN IN A DIGITAL DRIVING

(75) Inventors: Jungmin Seo, Daegu (KR); Eunmyung Park, Daegu (KR)

(73) Assignee: LG Display Co., Ltd., Seoul (KR)

( * ) Notice: Subject to any disclaimer, the term of this patent is extended or adjusted under 35 U.S.C. 154(b) by 601 days.

(21) Appl. No.: 12/533,848

(22) Filed: Jul. 31, 2009

(65) Prior Publication Data

US 2010/0117935 A1 May 13, 2010

(30) Foreign Application Priority Data

Nov. 11, 2008 (KR) ..... 10-2008-0111773

(51) Int. Cl.
*G09G 3/32* (2006.01)

(52) U.S. Cl. ..... 345/82

(58) Field of Classification Search ..... 345/76, 345/82, 204, 77; 315/169.4
See application file for complete search history.

(56) References Cited

U.S. PATENT DOCUMENTS

2003/0197667 A1* 10/2003 Numao ..... 345/82
2005/0212729 A1* 9/2005 Chung et al. ..... 345/76
2005/0243077 A1* 11/2005 Chung et al. ..... 345/204
2005/0275647 A1* 12/2005 Numao ..... 345/204
2007/0058087 A1* 3/2007 Kettle et al. ..... 348/742
2008/0158262 A1* 7/2008 Russell et al. ..... 345/690

* cited by examiner

*Primary Examiner* — Chanh Nguyen
*Assistant Examiner* — Pegeman Karimi
(74) *Attorney, Agent, or Firm* — Brinks Hofer Gilson & Lione

(57) ABSTRACT

An organic light emitting diode (OLED) display is disclosed. The OLED display includes a display panel, a gate drive circuit, a data converter that divides video data corresponding to 1 frame into a plurality of bit-planes each having a different bitrate, maps bit-planes having a relatively large value of assigned time to first subfields, and maps bit-planes having a relatively small value of assigned time to second subfields arranged between the first subfields, so that time assigned values of successively arranged subfields have a zigzag pattern and a last subfield of the successively arranged subfields has a maximum time assigned value, and a data drive circuit.

4 Claims, 13 Drawing Sheets

| Bit | The number of subfields | Relative time assigned value |
|---|---|---|
| 0 | 1 | 1 |
| 1 | 1 | 2 |
| 2 | 2 | 2+2 |
| 3 | 2 | 4+4 |
| 4 | 4 | 4+4+4+4 |
| 5 | 4 | 8+8+8+8 |
| 6 | 4 | 16+16+16+16 |
| 7 | 6 | 21+21+21+21+21+23 |
| | 24 | |

FIG. 10

| Bit | The number of subfields | Relative time assigned value |
|---|---|---|
| 0 | 1 | 1 |
| 1 | 1 | 2 |
| 2 | 2 | 2+2 |
| 3 | 2 | 4+4 |
| 4 | 4 | 4+4+4+4 |
| 5 | 4 | 8+8+8+8 |
| 6 | 4 | 16+16+16+16 |
| 7 | 6 | 21+21+21+21+21+23 |
| | 24 | |

FIG. 11

| SF | Bit | Relative time assigned value |
|---|---|---|
| 0 | 5 | 8 |
| 1 | 3 | 4 |
| 2 | 7 | 21 |
| 3 | 1 | 2 |
| 4 | 6 | 16 |
| 5 | 4 | 4 |
| 6 | 2 | 2 |
| 7 | 7 | 21 |
| 8 | 5 | 8 |
| 9 | 0 | 1 |
| 10 | 6 | 16 |
| 11 | 7 | 21 |
| 12 | 4 | 4 |
| 13 | 5 | 8 |
| 14 | 2 | 2 |
| 15 | 7 | 21 |
| 16 | 3 | 4 |
| 17 | 6 | 16 |
| 18 | 4 | 4 |
| 19 | 5 | 8 |
| 20 | 7 | 21 |
| 21 | 6 | 16 |
| 22 | 4 | 4 |
| 23 | 7 | 23 |

| Bit | The number of subfields | Relative time assigned value |
|---|---|---|
| 0 | 1 | 1 |
| 1 | 1 | 2 |
| 2 | 1 | 4 |
| 3 | 1 | 8 |
| 4 | 3 | 5+5+6 |
| 5 | 3 | 10+11+11 |
| 6 | 4 | 16+16+16+16 |
| 7 | 6 | 21+21+21+21+21+23 |
| | 20 | |

FIG. 14

| Bit | The number of subfields | Relative time assigned value |
|---|---|---|
| 0 | 1 | 1 |
| 1 | 1 | 2 |
| 2 | 1 | 4 |
| 3 | 1 | 8 |
| 4 | 2 | 8+8 |
| 5 | 4 | 8+8+8+8 |
| 6 | 4 | 16+16+16+16 |
| 7 | 6 | 21+21+21+21+21+23 |
| | 20 | |

FIG. 15

| Bit | The number of subfields | Relative time assigned value |
|---|---|---|
| 0 | 1 | 1 |
| 1 | 1 | 2 |
| 2 | 1 | 4 |
| 3 | 2 | 4+4 |
| 4 | 2 | 8+8 |
| 5 | 3 | 10+11+11 |
| 6 | 4 | 16+16+16+16 |
| 7 | 6 | 21+21+21+21+21+23 |
| | 20 | |

ORGANIC LIGHT EMITTING DIODE DISPLAY DRIVEN IN A DIGITAL DRIVING

RELATED APPLICATIONS

This application claims the benefit of Korea Patent Application No. 10-2008-0111773 filed on Nov. 11, 2008, the entire contents of which is incorporated herein by reference for all purposes as if fully set forth herein.

BACKGROUND

1. Field

Embodiments of the disclosure relate to an organic light emitting diode (OLED) display driven in a digital driving manner.

2. Related Art

Various flat panel displays whose weight and size are smaller than cathode ray tubes have been recently developed. Examples of the flat panel displays include a liquid crystal display (LCD), a field emission display (FED), a plasma display panel (PDP), and an electroluminescence device.

Because the PDP has a simple structure and is manufactured through a simple process, the PDP has been considered as a display device having characteristics such as lightness in weight and thin profile and providing the large-sized screen. However, the PDP has disadvantages such as low light emitting efficiency, low luminance, and high power consumption. A thin film transistor (TFT) LCD using a TFT as a switching element is the most widely used flat panel display. However, because the TFT LCD is not a self-emission display, the TFT LCD has a narrow viewing angle and a low response speed. The electroluminescence device is classified into an inorganic light emitting diode display and an organic light emitting diode (OLED) display depending on a material of an emitting layer. Because the OLED display is a self-emission display, the OLED display has characteristics such as a fast response speed, a high light emitting efficiency, a high luminance, and a wide viewing angle.

The OLED display, as shown in FIG. 1, includes an organic light emitting diode. The organic light emitting diode includes organic compound layers between an anode electrode and a cathode electrode. The organic compound layers include a hole injection layer HIL, a hole transport layer HTL, an emitting layer EML, an electron transport layer ETL, and an electron injection layer EIL. When a driving voltage is applied to the anode electrode and the cathode electrode, holes passing through the hole transport layer HTL and electrons passing through the electron transport layer ETL move to the emitting layer EML and form an exciton. Hence, the emitting layer EML generates visible light.

The OLED display may be classified into an analog type OLED display and a digital type OLED display depending on a driving manner of the OLED display. In the analog type OLED display, as shown in FIG. 2A, a gray scale is represented by applying a data voltage, whose a magnitude varies, or a data current, whose a magnitude varies, to pixels. In the digital type OLED display, as shown in FIG. 2B, a gray scale is represented by changing an application time of a data voltage having a constant magnitude or a data current having a constant magnitude.

In the analog type OLED display, electrical characteristics (for example, threshold voltage, electron mobility, etc.) of a drive TFT, that controls an amount of current flowing in the organic light emitting diode depending on the magnitude of the data voltage or the data current, change depending on driving time or process conditions in each pixel. Therefore, it is difficult to accurately represent the gray scale in the analog type OLED display. In the digital type OLED display, because a drive TFT is used as only a switching element, a reduction in image quality resulting from a difference between electrical characteristics of a drive TFT can be prevented.

In the general digital type OLED display, video data corresponding to 1 frame is divided into j bit-planes (where j is a integer equal to or greater than 2), and 1 frame is time-divided into k subfields (where k is a integer equal to or greater than 2), so that the OLED display displays the video data during 1 frame period. Each of the j bit-planes is assigned to one subfield or the plurality of subfields.

In the digital type OLED display, it looks like a subfield of a previous frame and a subfield of a current frame overlap because of a difference between an integral direction of light and visual characteristics of the light perceived through the human eye. As a result, a dynamic false contour noise in which a luminance is distorted may occur. The dynamic false contour noise is generally measured in the form of white band or black band. In particular, the dynamic false contour noise remarkably occurs when gray levels (for example, 127-128, 63-64, and 31-32), whose light emitting patterns are greatly different from each other, are successively represented. For example, as shown in FIG. 3, when a value of gray level changes from 31 to 32, a brightness difference between two frames is 1. However, first to fifth subfields T1 to T5 are turned on so as to represent 31-gray level, and a sixth subfield T6 is turned on so as to represent 32-gray level. When the gray level changes from 31 to 32, a moving amount of a light emitting point increases because of a large time lag between light emitting patterns in the two frames. As a result, the dynamic false contour noise occurs.

The time lag between the light emitting patterns in the two frames allows a driving frequency F2 perceived through the human eye to be smaller than an original driving frequency F1 and thus may cause a screen flicker.

BRIEF SUMMARY

Embodiments of the disclosure provide an organic light emitting diode (OLED) display driven in a digital driving manner capable of improving image quality by reducing a dynamic false contour noise and a flicker.

In one aspect, there is an organic light emitting diode (OLED) display comprising a display panel including a plurality of scan lines receiving a scan pulse, a plurality of erase lines receiving an erase pulse, a plurality of data lines, and a plurality of pixels each having an organic light emitting diode at each of crossings of the scan lines, the erase lines, and the data lines, a gate drive circuit that generates the scan pulse and the erase pulse so that subfields are turned on for a previously determined value of assigned time, a data converter that divides video data corresponding to 1 frame into a plurality of bit-planes each having a different bitrate, maps bit-planes having a relatively large value of assigned time to first subfields, and maps bit-planes having a relatively small value of assigned time to second subfields arranged between the first subfields, so that time assigned values of successively arranged subfields have a zigzag pattern and a last subfield of the successively arranged subfields has a maximum time assigned value, and a data drive circuit that converts the video data undergoing the mapping into a data voltage and supplies the data voltage to the data lines.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings:

FIG. 10 illustrates examples of the number of subfields and a relative time assigned time according to a bitrate of bit-plane;

FIG. 11 illustrates a time mapping table;

FIG. 12 is a graph illustrating relative time assigned values of subfields; and FIGS. 13 to 15 illustrate examples of the number of subfields and a relative time assigned value according to a bitrate of bit-plane.

DETAILED DESCRIPTION OF THE DRAWINGS AND THE PRESENTLY PREFERRED EMBODIMENTS

Reference will now be made in detail embodiments of the invention examples of which are illustrated in the accompanying drawings.

Figure 1:
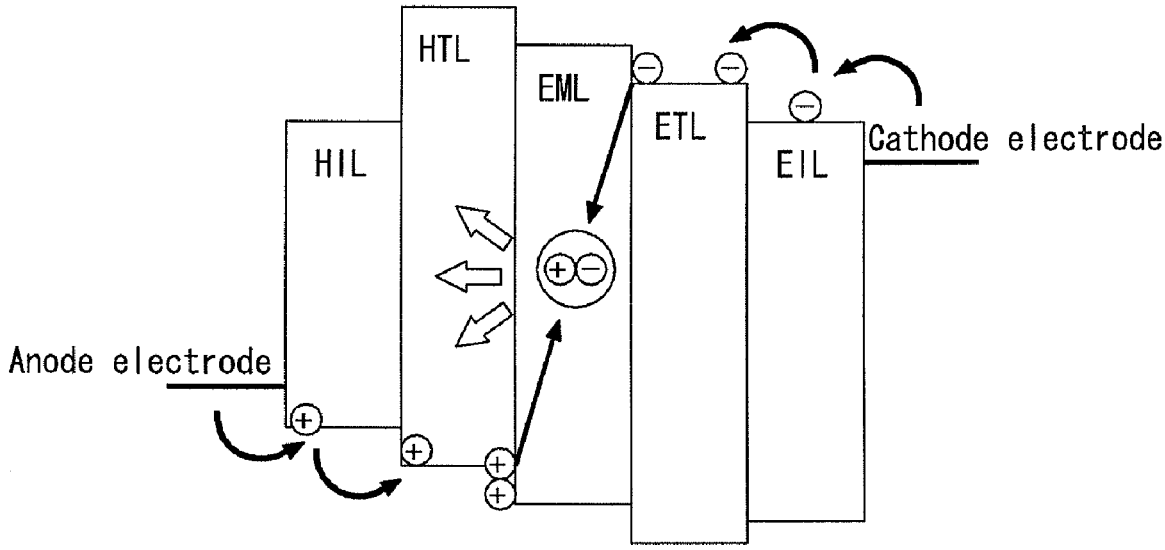
FIG. 1 (Related Art)
FIG. 1 is a diagram illustrating a light emitting principle of a general organic light emitting diode (OLED) display.
Figure 2A:
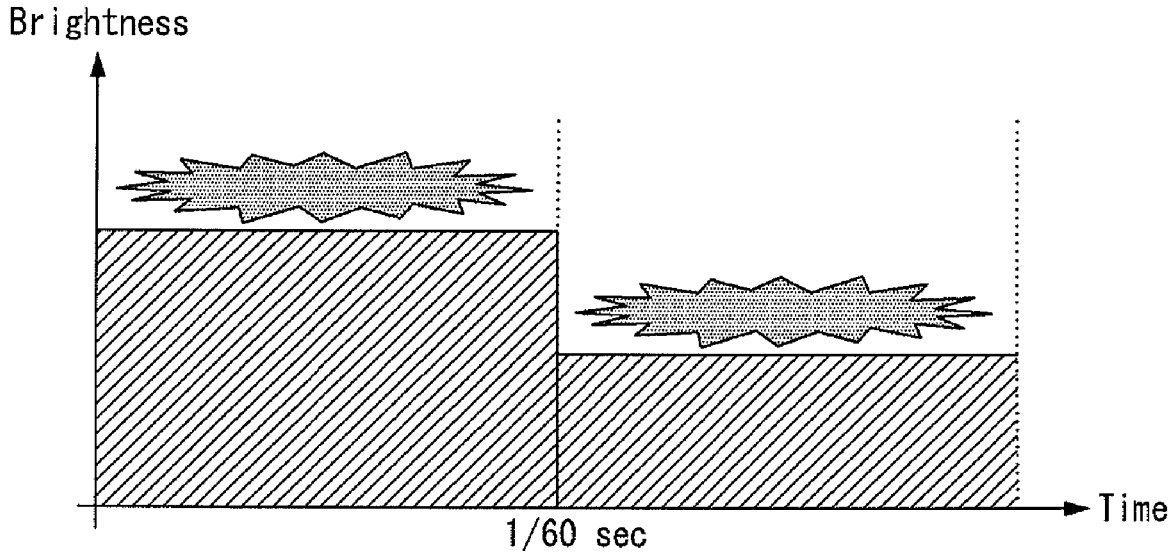
FIG. 2A (Related Art)
FIG. 2A illustrates an analog driving manner of an analog type OLED display.
Figure 2B:
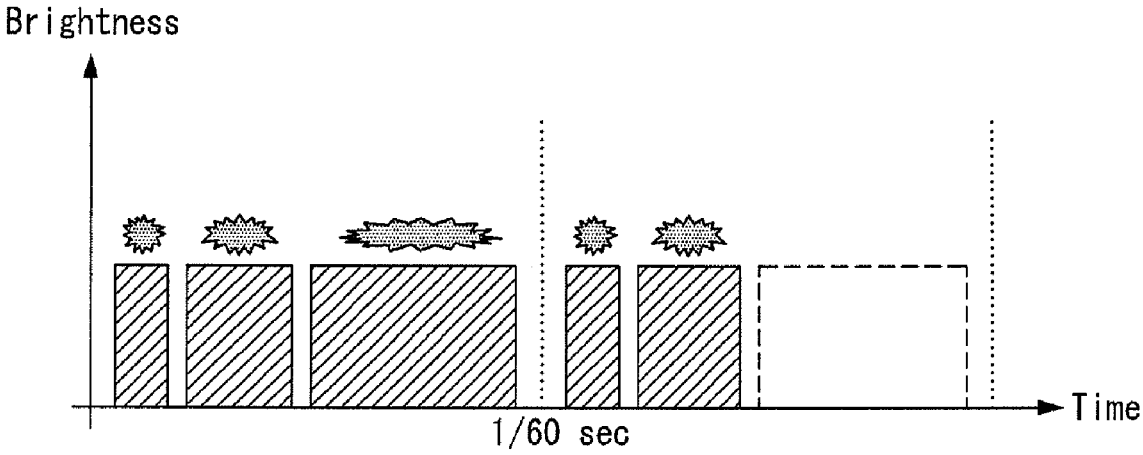
FIG. 2B (Related Art)
FIG. 2B illustrates a digital driving manner of a digital type OLED display.
Figure 3:
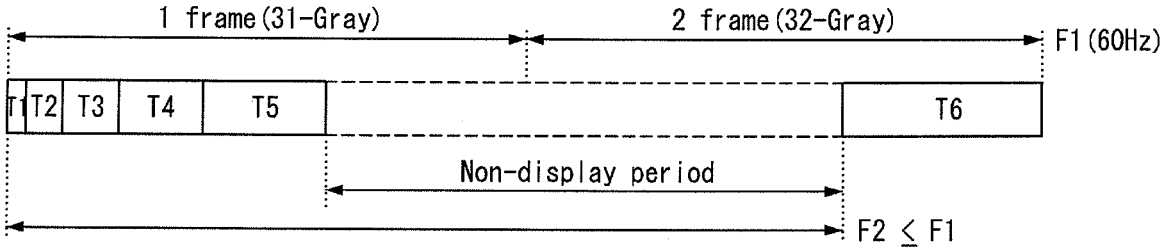
FIG. 3 (Related Art)
FIG. 3 illustrates a reason why a dynamic false contour noise and a flicker occur in a related art digital driving manner.
Figure 4:
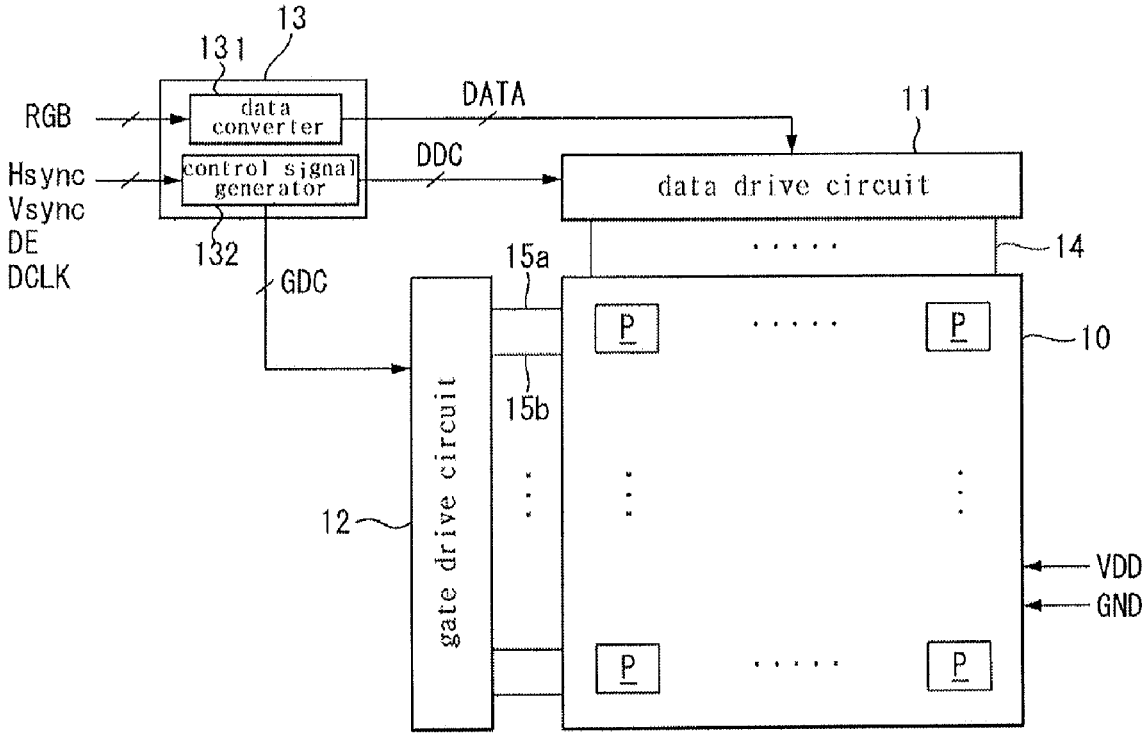
FIG. 4 is a block view showing an exemplary configuration of an OLED display according to an embodiment of the invention.
Figure 5:
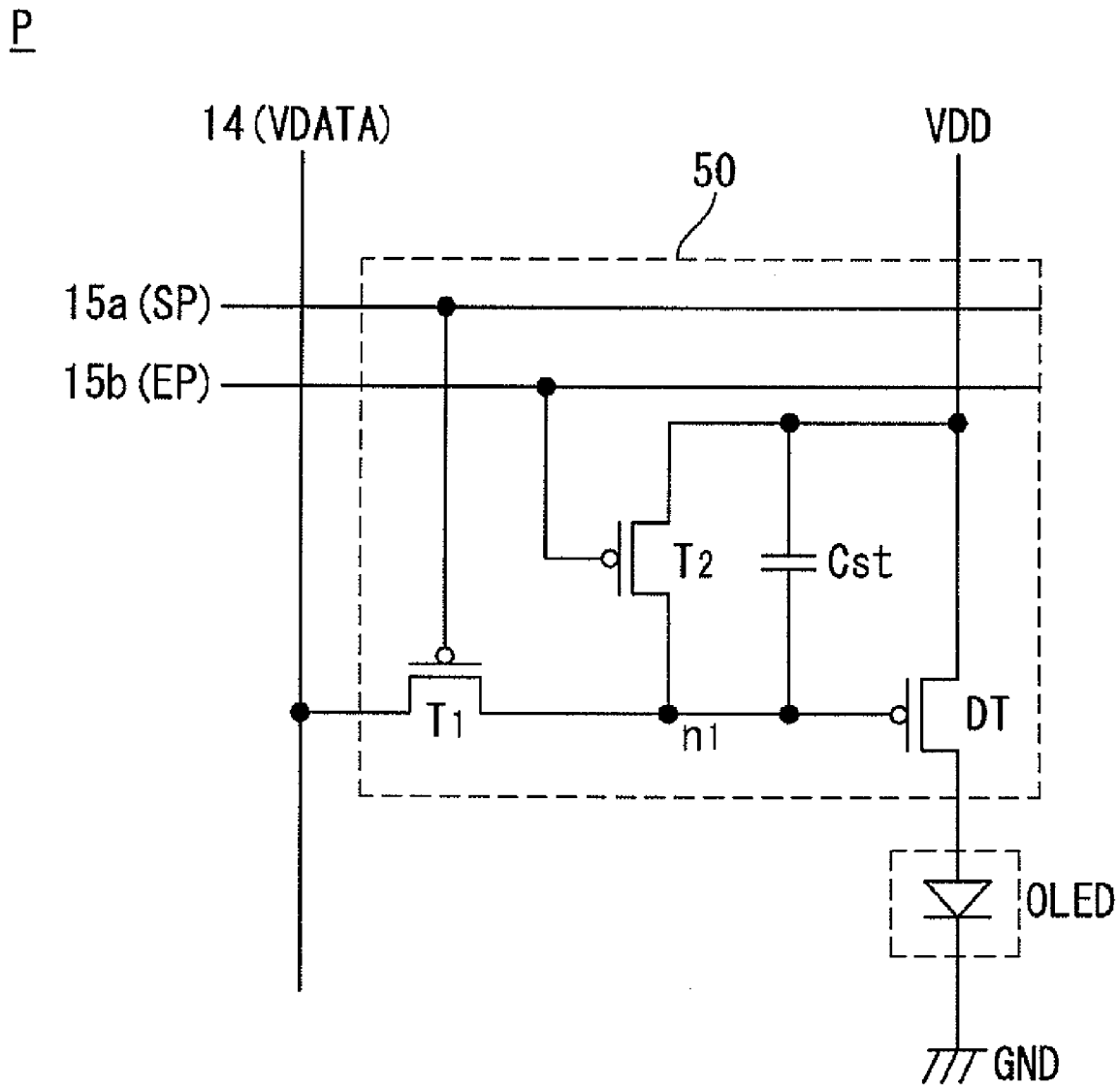
FIG. 5 is an equivalent circuit diagram of a pixel.
Figure 6:
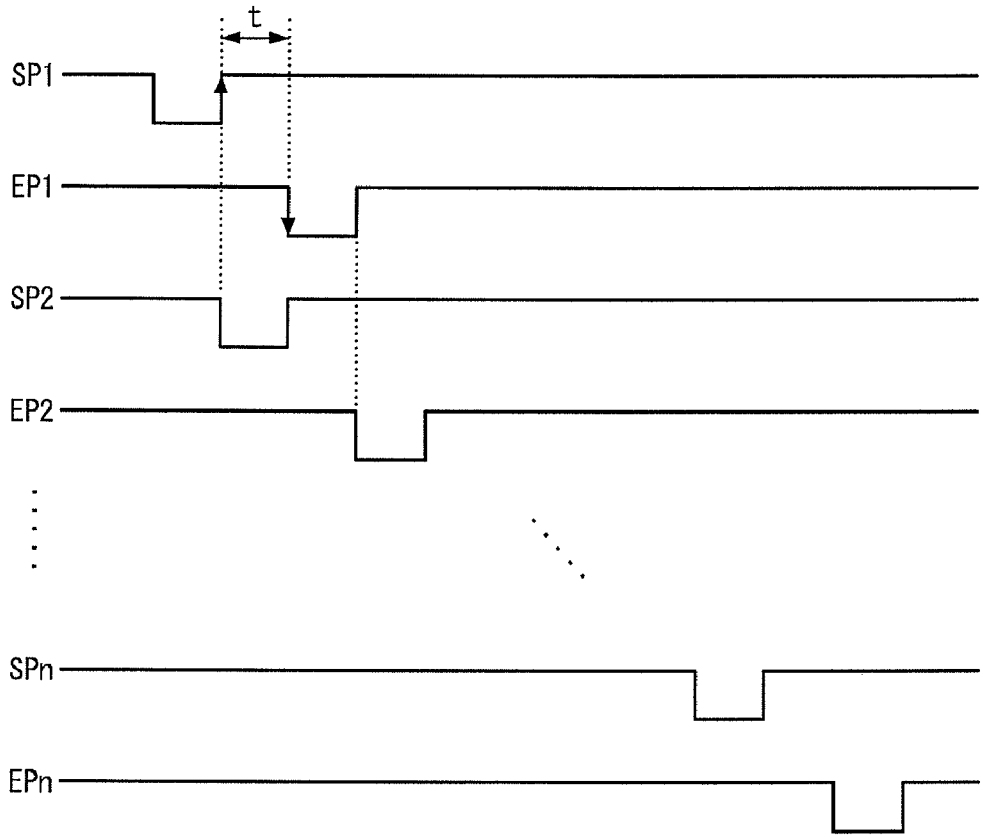
FIG. 6 is a timing diagram of a scan pulse and an erase pulse supplied to a pixel in a predetermined subfield.
Figure 7:
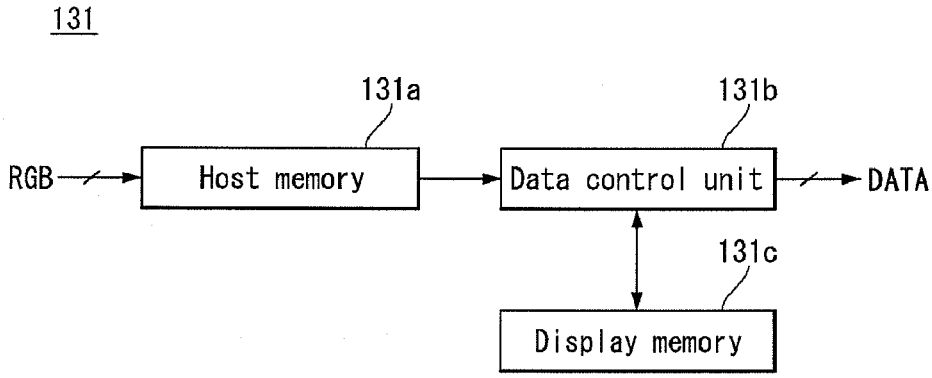
FIG. 7 illustrates a data converter of a controller.
Figure 8:
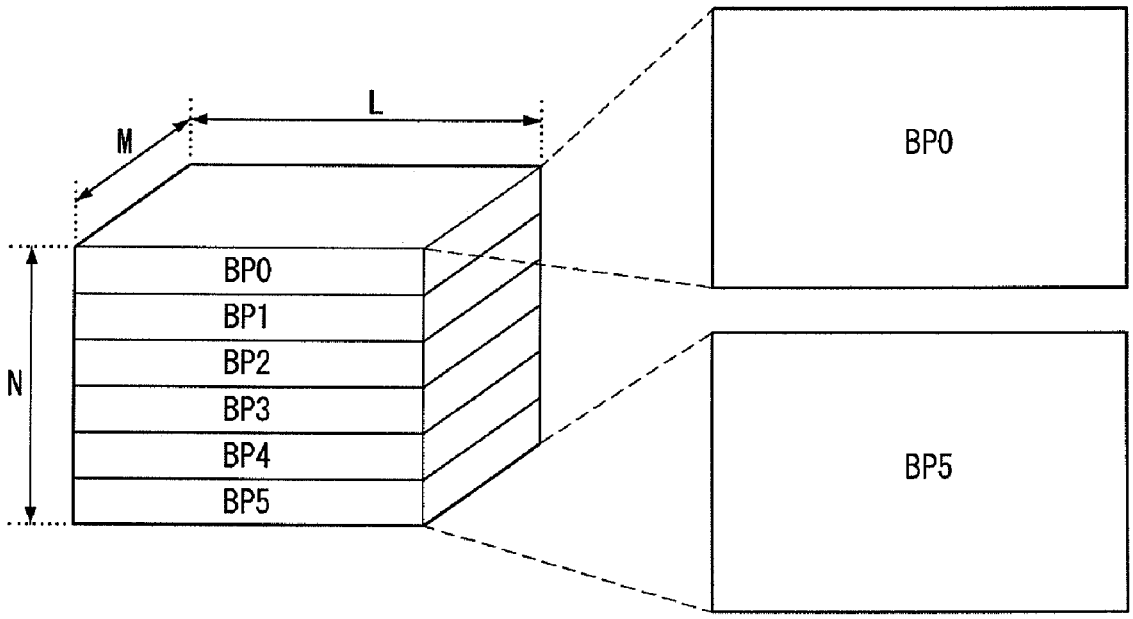
FIG. 8 illustrates that video data corresponding to 1 frame is divided into a plurality of bit-planes.
Figure 9:
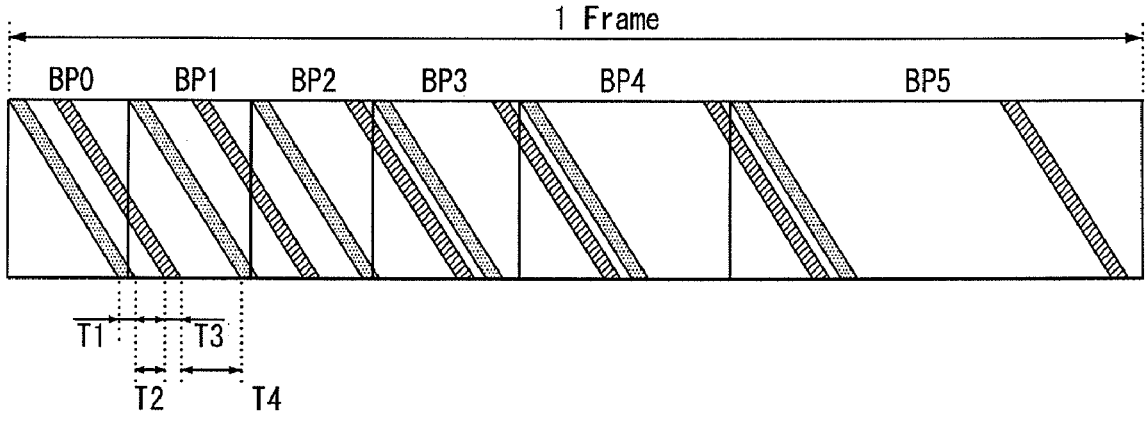
FIG. 9 illustrates changes in a display time assigned value according to a bitrate of a bit-plane in 1 frame period.

FIG. 4 is a block view showing an exemplary configuration of an organic light emitting diode (OLED) display according to an embodiment of the invention. FIG. 5 is an equivalent circuit diagram of a pixel. FIG. 6 is a timing diagram of a scan pulse and an erase pulse supplied to a pixel in a predetermined subfield. FIG. 7 illustrates a data converter of a controller. FIG. 8 illustrates that video data corresponding to 1 frame is divided into a plurality of bit-planes. FIG. 9 illustrates changes in a display time assigned value according to a bitrate of a bit-plane in 1 frame period.

As shown in FIG. 4 to 9, the OLED display according to the embodiment of the invention includes a display panel 10, a data drive circuit 11, a gate drive circuit 12, and a controller 13.

The display panel 10 includes a plurality of data lines 14, a plurality of scan lines 15*a*, and a plurality of erase lines 15*b* that cross one another, and a plurality of pixels P, each of which is arranged at each of crossings of the lines 14, 15*a*, and 15*b*. Each of the pixels P, as shown in FIG. 5, includes a high potential driving voltage source VDD, a ground level voltage source GND, an organic light emitting diode OLED connected between the high potential driving voltage source VDD and the ground level voltage source GND, and a cell driving circuit 50 for driving the organic light emitting diode OLED in response to driving signals received from the lines 14, 15*a*, and 15*b*.

The cell driving circuit 50 is connected between the organic light emitting diode OLED and the high potential driving voltage source VDD. The cell driving circuit 50 includes a driving thin film transistor (TFT) DT performing a switching operation depending on a voltage of a first node n1, a first switching TFT T1 that is connected between the data line 14 and the first node n1 and performs a switching operation in response to a scan pulse SP from the scan line 15*a*, a second switching TFT T2 that is connected between the high potential driving voltage source VDD and the first node n1 and performs a switching operation in response to an erase pulse EP from the erase line 15*b*, and a storage capacitor Cst connected between the high potential driving voltage source VDD and the first node n1. In the embodiment, the thin film transistors may use a p-type metal-oxide semiconductor field effect transistor (MOSFET). In the driving TFT DT, a gate terminal is connected to the first node n1, a source terminal is connected to the high potential driving voltage source VDD, and a drain terminal is connected to an anode electrode of the organic light emitting diode OLED. In the first switching TFT T1, a gate terminal is connected to the scan line 15*a*, a source terminal is connected to the data line 14, and a drain terminal is connected to the first node n1. In the second switching TFT T2, a gate terminal is connected to the erase line 15*b*, a source terminal is connected to the high potential driving voltage source VDD, and a drain terminal is connected to the first node n1. The storage capacitor Cst keeps the first node n1 at a data voltage VDATA until the second switching TFT T2 is turned on immediately after the first switching TFT T1 is turned on.

In each of the pixels P, when the first switching TFT T1 is turned on in response to the scan pulse SP from the scan line 15*a*, the data voltage VDATA from the data line 14 is applied to the first node n1. Hence, the driving TFT DT is turned on, and the organic light emitting diode OLED emits light because of the turned-on driving TFT DT. Subsequently, when the second switching TFT T2 is turned on in response to the erase pulse EP from the erase line 15*b*, a voltage of the first node n1 rises from the data voltage VDATA to a voltage level of the high potential driving voltage source VDD. Hence, the driving TFT DT is turned off, and the organic light emitting diode OLED stops emitting light because of the turned-off driving TFT DT. A light emitting period of the organic light emitting diode OLED, as shown in FIG. 6, is determined depending on a time lag t between a rising edge of the scan pulse SP and a falling edge of the erase pulse EP. A time lag in a subfield having a large value of assigned time is greater than a time lag in a subfield with a small value of assigned time.

The data drive circuit 11 converts data DATA received from the controller 13 into the analog data voltage VDATA in response to a data control signal DDC generated by the controller 13 and supplies the analog data voltage VDATA to the data lines 14.

As shown in FIG. 6, the gate drive circuit 12 generates the scan pulses SP and the erase pulses EP in response to a gate control signal GDC generated by the controller 13, sequentially supplies the scan pulses SP to the scan lines 15*a* to sequentially drive the scan lines 15*a*, and sequentially supplies the erase pulses EP to the erase lines 15*b* to sequentially drive the erase lines 15*b*, so that corresponding subfields are turned on for a previously determined value of assigned time. There is a predetermined time lag between a falling edge of the erase pulse EP and a rising edge of the scan pulse SP in conformity with a turned-on period of each of the corresponding subfields.

The controller 13 includes a data converter 131 and a control signal generator 132.

The data converter 131 converts digital video data RGB into data format suitable for a digital driving manner. The data converter 131 includes a host memory 131*a*, a data control unit 131*b*, and a display memory 131*c*. The host memory 131*a* stores the digital video data RGB, corresponding to each frame, received from the outside. The data control unit 131*b* divides the digital video data RGB, corresponding to 1 frame, composed of L×M×N (where L is a horizontal resolution, M is a vertical resolution, and N is bitrate) into (N+1) bit-planes. For example, as shown in FIG. 8, if the data control unit 131*b* receives digital video data RGB, corresponding to 1 frame, composed of L×M×5 from the host memory 131*a*, the data control unit 131*b* divides the digital video data RGB into 6 bit-planes BP0 to BP5.

The digital video data RGB is divided into a plurality of bit-planes, and the plurality of bit-planes are represented once or several times during 1 frame period. For this, the data control unit 131*b* divides one frame into a plurality of subfields. The number of subfields may be equal to or greater than the number of bit-planes. When the number of subfields is equal to the number of bit-planes, a display time assigned to a bit-plane having a large bitrate increases. When the number of subfields is greater than the number of bit-planes, the number of subfields as well as a display time assigned to a bit-plane having a large bitrate increase. For example, because the bit-plane BP5 has a larger bitrate than the bit-plane BP0 as shown in FIG. 8, a display time assigned to the bit-plane BP5 is longer than a display time assigned to the bit-plane BP0 as shown in FIG. 9. In FIG. 9, T1 indicates an address period for display, T2 a display period, T3 is an address period for erase, and T4 an erase period. The data control unit 131*b* maps a bit-plane to be represented in a predetermined subfield to a corresponding subfield using a time mapping table, and then the mapped bit-plane is stored in the display memory 131*c*. In particular, the data control unit 131*b* allows the number of subfields and a display time assigned to a bit-plane having a large bitrate to increase through the mapping so as to reduce a dynamic false contour noise and a flicker. The data control unit 131*b* maps bit-planes having a relatively large assigned value of display time to first subfields and maps bit-planes having a relatively small assigned value of display time to second subfields arranged between the first subfields. In this case, the data control unit 131*b* performs the mapping operation, so that successively arranged subfields have display time assigned values of zigzag pattern and a last subfield of the successively arranged subfields has a maximum display time assigned value. The data control unit 131*b* supplies the video data undergoing the mapping operation to the data drive circuit 11.

The control signal generator 132 receives timing signals, such as horizontal and vertical sync signals Hsync and Vsync, a data enable signal DE, and a dot clock signal DCLK from the outside to generate a data timing control signal DDC for controlling operation timing of the data drive circuit 11 and a gate timing control signal GDC for controlling operation timing of the gate drive circuit 12. The data timing control signal DDC includes a source sampling clock signal indicating a latch operation of data inside the data drive circuit 11 based on a rising or falling edge, a source output enable signal indicating an output of the data drive circuit 11, and the like. The gate timing control signal GDC includes a gate start pulse, a gate shift clock signal, a gate output enable signal, and the like. The gate start pulse indicates a start horizontal line of a scan or erase operation. The gate shift clock signal is a timing control signal that is input to a shift resistor of the gate drive circuit 12 to sequentially shift the gate start pulse and has a pulse width corresponding to on-period of the TFT. The gate output enable signal indicates an output of the gate drive circuit 12.

Figures 12, 13:
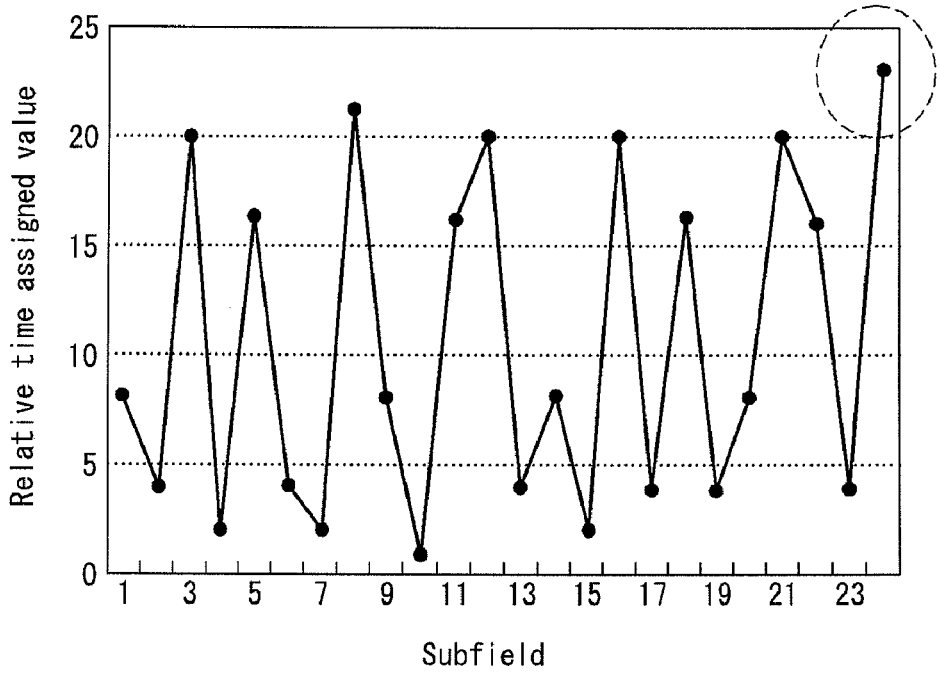

FIG. 10 illustrates examples of the number of subfields and an assigned value of relative time according to a bitrate of bit-plane. FIG. 11 illustrates a time mapping table. FIG. 12 is a graph illustrating relative time assigned values of subfields.

As shown in FIG. 10, video data is divided into 8 bit-planes according to a bitrate of the video data, and the number of subfields is 24. As a bitrate of the bit-plane increases, the number of subfields and relative time assigned values of the subfields increase. For example, 1 subfield having a relative time assigned value of 2 is assigned to a bit plane for 1-bit. 2 subfields having a relative time assigned value of 4 are assigned to a bit plane for 3-bit. 4 subfields having a relative time assigned value of 8 are assigned to a bit plane for 5-bit. 5 subfields having a relative time assigned value of 21 and 1 subfield having a relative time assigned value of 23 are assigned to a bit plane for 7-bit. 1 subfield or the plurality of subfields assigned to each bit plane are mapped through a time mapping table shown in FIG. 11. For example, the bit plane for 1-bit is mapped to a 3rd subfield, and the bit plane for 3-bit is mapped to 1st and 16th subfields. The bit plane for 5-bit is mapped to 0th, 8th, 13th, and 19th subfields, and the bit plane for 7-bit is mapped to 2nd, 7th, 11th, 15th, 20th, and 23th subfields. It is preferable that a relative time assigned value mapped to a 23th subfield is a maximum value of 23 in consideration of time efficiency. As shown in FIG. 12, the relative time assigned values of the successively arranged subfields have the zigzag pattern through the time mapping. When the successively arranged subfields are time-mapped to have the relative time assigned values of zigzag pattern, a time lag between light emitting patterns in two frames is reduced. Hence, the dynamic false contour noise and the flicker are greatly reduced. When the time mapping is performed so that the subfield having the maximum relative time assigned value is a last subfield, the time efficiency greatly increases.

FIGS. 13 to 15 illustrate examples of the number of subfields and a relative time assigned value according to a bitrate of bit-plane.

As shown in FIGS. 13 to 15, video data is divided into 8 bit-planes according to a bitrate of the video data, and the number of subfields is 20. As a bitrate of the bit-plane increases, the number of subfields and relative time assigned values of the subfields increase. 1 subfield or the plurality of subfields assigned to each bit plane are mapped through a time mapping table in a similar manner to FIG. 11. Thus, the successively arranged subfields are time-mapped to have relative time assigned values of zigzag pattern. Further, the time mapping is performed so that a subfield having a maximum relative time assigned value is a last subfield.

As described above, in the OLED display according to the embodiment of the invention, because the time-mapping operation is performed so that relative time assigned values of successively arranged subfields have a zigzag pattern, a time lag between light emitting patterns in two frames is reduced. Hence, the dynamic false contour noise and the flicker are greatly reduced. Furthermore, because the time mapping is performed so that a subfield having a maximum relative time assigned value is a last subfield, the time efficiency greatly increases.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

The invention claimed is:

1. An organic light emitting diode display comprising:

a display panel including a plurality of scan lines receiving scan pulse, a plurality of erase lines receiving erase pulse, a plurality of data lines, and a plurality of pixels each having an organic light emitting diode at each of crossings of the scan lines, the erase lines, and the data lines;

a gate drive circuit that generates the scan pulse and the erase pulse so that subfields are turned on for a previously determined value of assigned time;

a data converter that divides video data corresponding to 1 frame into a plurality of bit-planes each having a different bitrate, maps bit-planes having a relatively large value of assigned time to first subfields, and maps bit-planes having a relatively small value of assigned time to second subfields arranged between the first subfields, so that time assigned values of successively arranged subfields have a zigzag pattern and a last subfield of the successively arranged subfields has a first maximum time assigned value; and a data drive circuit that converts the video data undergoing the mapping into a data voltage and supplies the data voltage to the data lines, wherein as a bitrate of bit-plane increases, a number of subfields assigned to the bit-plane and relative time assigned values of the subfields increase, wherein one subfield having the first maximum time assigned value and a plurality of subfields having a second maximum time assigned value are assigned to a maximum bit-plane having a maximum bitrate, and wherein the second maximum time assigned value is less than the first maximum time assigned value.

2. The organic light emitting diode display of claim 1, wherein the data converter includes:

a host memory that stores the video data corresponding to the 1 frame;

a display memory having a time mapping table; and a data control unit that maps a predetermined bit-plane to 1 subfield or a plurality of subfields using the time mapping table.

3. The organic light emitting diode display of claim 1, wherein at least one second subfield is arranged between the first subfields.

4. The organic light emitting diode display of claim 1, wherein a number of subfields is greater than a number of bit-planes.

* * * * *